US008413472B2

(12) United States Patent
Chiang

(10) Patent No.: US 8,413,472 B2
(45) Date of Patent: Apr. 9, 2013

(54) COMBINATION SAFE DEPOSIT BOX

(76) Inventor: Tung-Lung Chiang, Yunlin County (TW)

( * ) Notice: Subject to any disclaimer, the term of this patent is extended or adjusted under 35 U.S.C. 154(b) by 311 days.

(21) Appl. No.: 13/015,395

(22) Filed: Jan. 27, 2011

(65) Prior Publication Data

US 2012/0192769 A1 Aug. 2, 2012

(51) Int. Cl.
*E05B 65/52* (2006.01)

(52) U.S. Cl. ..... 70/63; 109/73; 109/74; 109/77; 109/79; 119/497; 220/4.24

(58) Field of Classification Search ..... 70/63, 77, 70/78, 159–162; 109/58, 73–75, 77–85; 119/496–498; 220/4.21, 4.24, 4.26, 682, 220/683; 312/257.1
See application file for complete search history.

(56) References Cited

U.S. PATENT DOCUMENTS

| | | | | | |
|---|---|---|---|---|---|
| 179,843 | A * | 7/1876 | Diebold | 109/85 |
| 581,191 | A * | 4/1897 | Bell | 217/42 |
| 2,232,004 | A * | 2/1941 | Hunter | 264/254 |
| 2,512,711 | A * | 6/1950 | Bremer | 109/65 |
| 3,710,761 | A * | 1/1973 | Gregory | 119/496 |
| 3,771,686 | A * | 11/1973 | Brison | 220/4.21 |
| 3,844,634 | A * | 10/1974 | Kruger et al. | 312/351 |
| 4,231,482 | A * | 11/1980 | Bogan | 220/4.13 |
| 4,691,486 | A * | 9/1987 | Niekrasz et al. | 52/172 |
| 5,154,137 | A * | 10/1992 | Stanaland | 119/496 |
| 5,357,900 | A * | 10/1994 | Ho | 119/479 |
| 5,462,015 | A * | 10/1995 | Murphy | 119/496 |
| 5,802,801 | A * | 9/1998 | Hohns et al. | 52/792.1 |
| 6,223,917 | B1 * | 5/2001 | Bruder | 211/189 |
| 6,571,740 | B1 * | 6/2003 | Kinder et al. | 119/497 |
| 8,132,537 | B2 * | 3/2012 | Trunnell et al. | 119/496 |
| 8,336,500 | B1 * | 12/2012 | Britt | 119/472 |
| 2002/0092477 | A1 * | 7/2002 | Ross | 119/496 |
| 2002/0185082 | A1 * | 12/2002 | Saxe et al. | 119/498 |
| 2008/0197130 | A1 * | 8/2008 | Volkmann | 220/4.26 |
| 2010/0043720 | A1 * | 2/2010 | Yelverton | 119/496 |
| 2010/0192870 | A1 * | 8/2010 | Wood | 119/496 |

* cited by examiner

*Primary Examiner* — Lloyd Gall
(74) *Attorney, Agent, or Firm* — WPAT, P.C.; Anthony King

(57) ABSTRACT

A combination safe deposit box includes a first box shell and a second box shell fastened together to define a deposit space, a plurality of side guard frames and corner guard frames fastened to and covered on the abutted area between the first box shell and the second box shell, a rim frame affixed to the front side of the first box shell and a second box shell and capped on two distal ends of the connected series of the side guard frames and corner guard frames, and a door panel hinged to one side of the rim frame and adapted to close the deposit space.

10 Claims, 7 Drawing Sheets

COMBINATION SAFE DEPOSIT BOX

BACKGROUND OF THE INVENTION

1. Field of the Invention

The present invention relates to security boxes and more particularly, to a combination safe deposit box that is easy to assemble and convenient to carry and that keeps the storage items safely.

2. Description of the Related Art

Regular metal safe deposit boxes are to be installed in a fixed place, such as bank or home, and adapted for keeping precious or important things. However, a fixed type metal safety deposit box is inconvenient in use. When going to any other place, the user cannot carry the metal safety deposit box with oneself conveniently. A people sleeping out or working in other places will be unable to get a great relief when leaving an expensive electronic product, such as notebook computer, in the dormitory.

To solve the immobility problem of conventional metal safe deposit boxes, portable safe deposit boxes are created for storing important personal items. To achieve security and mobility, portable safe deposit boxes are commonly integrally molded from plastics. The tooling cost for a portable safe deposit box of this kind is quite expensive. Further, during blow molding, the wall thickness may be not accurately controlled, lowering the structural strength of the finished portable safe deposit box. Thus, the yield rate is low, wasting much the material and fabrication time. Further, during delivery, portable safe deposit boxes are arranged in stacks, occupying much delivery space and increasing the delivery cost.

SUMMARY OF THE INVENTION

The present invention has been accomplished under the circumstances in view. It is one object of the present invention to provide a combination safe deposit box, which is easy to assemble and convenient to carry and that keeps the storage items safely. The combination safe deposit box consists of a first box shell, a second box shell, side guard frames, corner guard frames, a rim frame and a door panel. By means of affixing the first box shell and the second box shell together, and then fastening the side guard frames and the corner guard frames to the first box shell and the second box shell, and then affixing the rim frame to the front side of the first box shell and the second box shell to stop the side guard frames and the corner guard frames in position, the combination safe deposit box is assembled, convenient for carrying and storing things safely.

To achieve this and other objects of the present invention, a combination safe deposit box comprises a first box shell, which is a substantially reverse U-shaped frame shell defining a front opening and a bottom opening and having a first front edge surrounding the front opening and a first side edge surrounding the bottom opening; a second box shell, which is a substantially U-shaped frame shell defining a front opening and a top opening and having a second front edge surrounding the front opening and a second side edge connected to the first side edge of the first box shell; a plurality of side guard frames respectively fastened to and covered on the first side edge and the second side edge; a plurality of corner guard frames connected between each two the side guard frames; a rim frame affixed to the first front edge and the second front edge to stop the side guard frames in place; and a door panel hinged to one side of the rim frame and adapted to close a deposit space defined in between the first box shell and the second box shell Other advantages and features of the present invention will be fully understood by reference to the following specification in conjunction with the accompanying drawings, in which like reference signs denote like elements of structure.

DETAILED DESCRIPTION OF THE PREFERRED EMBODIMENT

Figure 1:
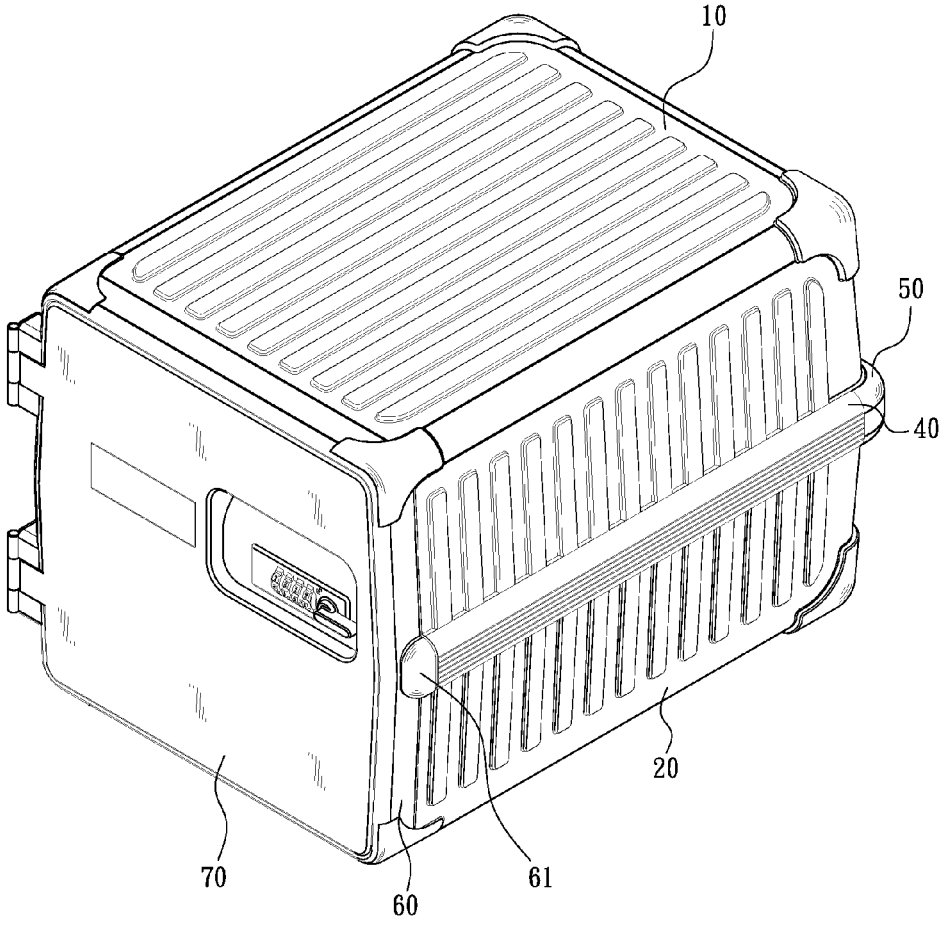
FIG. 1 is an elevational view of a combination safe deposit box in accordance with the present invention.
Figure 2:
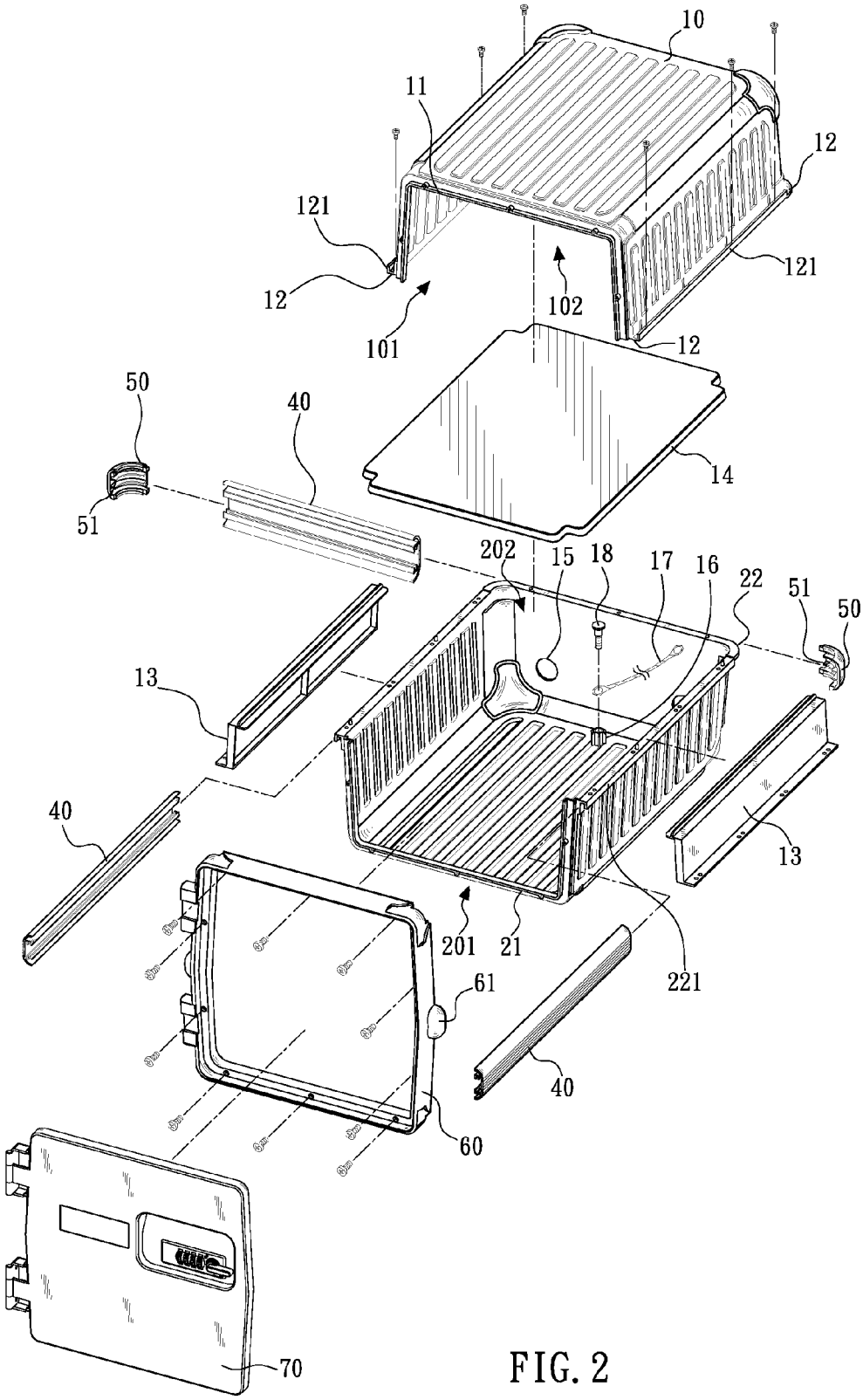
FIG. 2 is an exploded view of the combination safe deposit box in accordance with the present invention.

Referring to FIGS. 1-5, a combination safe deposit box in accordance with the present invention is shown comprising a first box shell 10, a second box shell 20, a plurality of side guard frames 40, a plurality of corner guard frames 50, a rim frame 60, and a door panel 70.

The first box shell 10 is a substantially reverse U-shaped frame shell defining a front opening 101 and a bottom opening 102, having a first front edge 11 surrounding the front opening 101, a first side edge 12 surrounding the bottom opening 102, and a first coupling flange 121 extending along the first side edge 12.

The second box shell 20 is a substantially U-shaped frame shell defining a front opening 201 and a top opening 202, having a second front edge 21 surrounding the front opening 201, a second side edge 22 connected to the first side edge 12 of the first box shell 10, and a second coupling flange 221 extending along the second side edge 22.

Further, two partition brackets 13 are bilaterally mounted in the first box shell 10 and the second box shell 20 to hold a partition board 14 that divides a deposit space 30 in between the first box shell 10 and the second box shell 20 into two separated deposit chambers.

Further, the first box shell 10 and the second box shell 20 each has at least one through hole 15 and one hollow column 16. A metal chain 17 is inserted through one said through hole 15 on the first box shell 10 or second box shell 20, having its one end affixed to the hollow column 16 of the first box shell 10 or second box shell 20 by a tie screw 18 and its other end for fastening to a selected place.

The side guard frames 40 are respectively fastened to and covered on the first side edge 12 and the second side edge 22. Each side guard frame 40 comprises two parallel coupling grooves 401 respectively coupled to the first coupling flange 121 of the first box shell 10 and the second coupling flange 221 of the second box shell 20. Further, after the side guard frames 40 are respectively fastened to the first coupling flange 121 of the first box shell 10 and the second coupling flange 221 of the second box shell 20, each side guard frame 40 covers a part of the first box shell 10 and a part of the second box shell 20, defining with the first box shell 10 and the second box shell 20 a respective channel 402.

The corner guard frames 50 are respectively connected between each two adjacent side guard frames 40, each having a coupling groove 51 attached to one corner area of the first side edge 12 and one respective corner area of the second side edge 22, and at least one pin 501 located on each of two distal ends thereof and respectively engaged into one respective channel 402 between one side guard frame 40 and the first box shell 10 or second box shell 20 to stop the side guard frames 40 in place.

The rim frame 60 is affixed to the first front edge 11 and the second front edge 21, having two cap-shaped lugs 61 respectively protruded from two opposite lateral sides thereof and respectively capped on one end of one respective side guard frame 40 to close the respective end of the respective side guard frame 40.

The door panel 70 is hinged to one side of the rim frame 60 and adapted to close the deposit space 30.

Thus, the first box shell 10 and the second box shell 20 are fastened together, then the side guard frames 40 and the corner guard frames 50 are respectively fastened to the first box shell 10 and the second box shell 20 and covered on the first side edge 12 and the second side edge 22, and then the rim frame 60 is affixed to the first front edge 11 and the second front edge 21 to stop the side guard frames 40 and the corner guard frames 50 in position. When assembled, the combination safe deposit box is convenient to carry and can well protect storage items safely.

After understanding of the structural details, the operation and principle of the invention will be outlined hereinafter.

Figure 3:
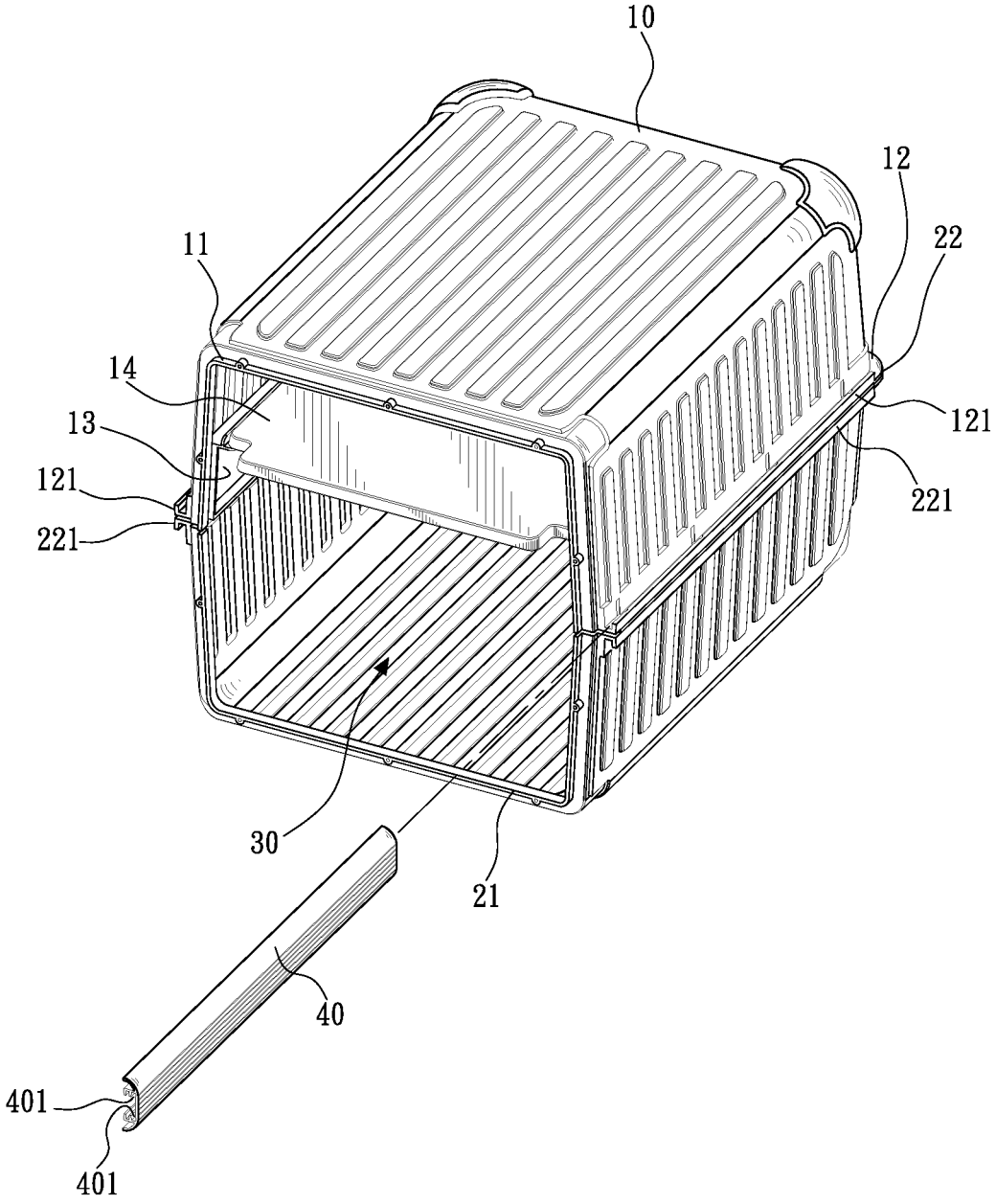
FIG. 3 is a schematic drawing illustrating an assembly process of the combination safe deposit box in accordance with the present invention (I).
Figure 4:
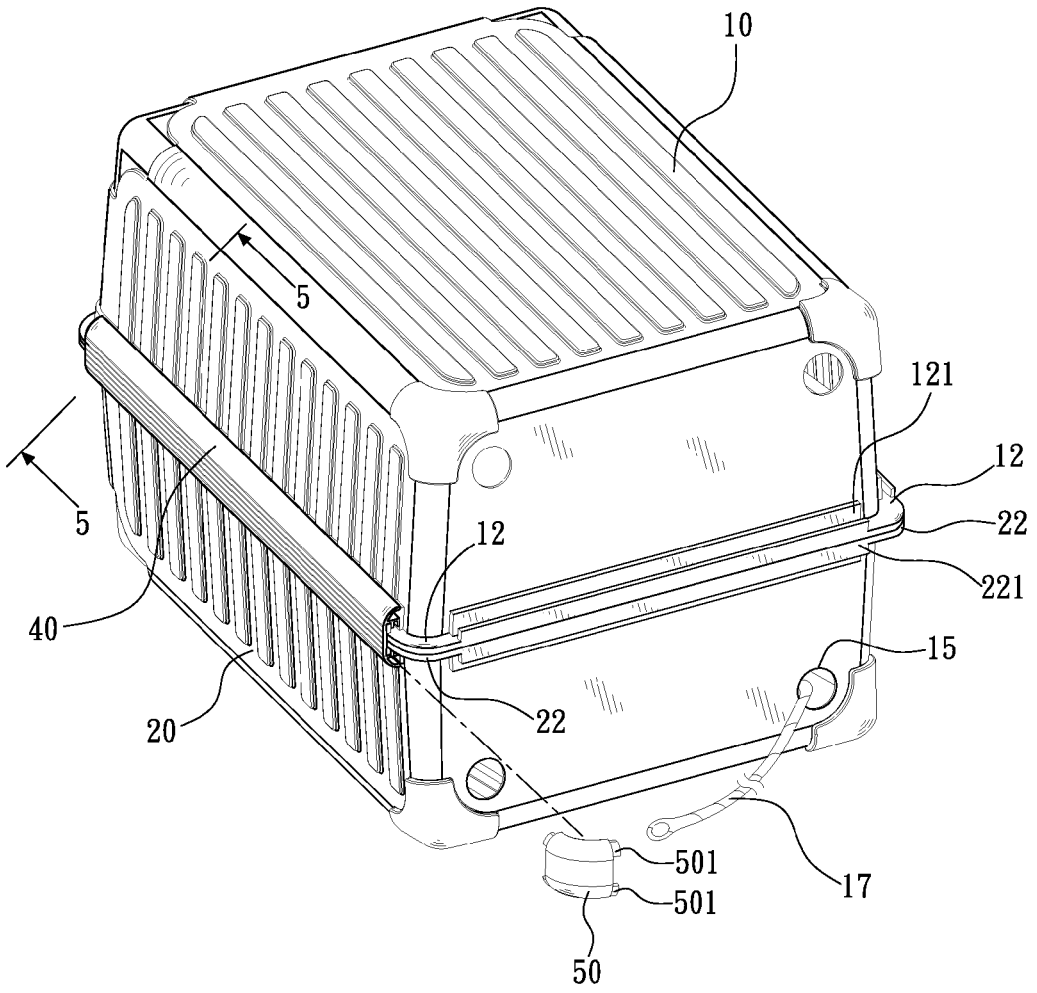
FIG. 4 is a schematic drawing illustrating an assembly process of the combination safe deposit box in accordance with the present invention (II).

FIGS. 3~7 illustrate the process to assemble the combination safe deposit box. At first, as shown in FIG. 3, abut the first side edge 12 of the first box shell 10 against the second side edge 22 of the second box shell 20 and then fixedly fasten the first side edge 12 and the second side edge 22 with screws, and then press-fit the side guard frames 40 onto the abutted first side edge 12 and second side edge 22 to let the first coupling flange 121 and the second coupling flange 221 be respectively inserted into the respective coupling grooves 401 in the side guard frames 40, as shown in FIG. 4, and therefore the side guard frames 40 cover the first side edge 12 and the second side edge 22 to keep the installed screws from sight and secure them tightly together.

Figure 5:
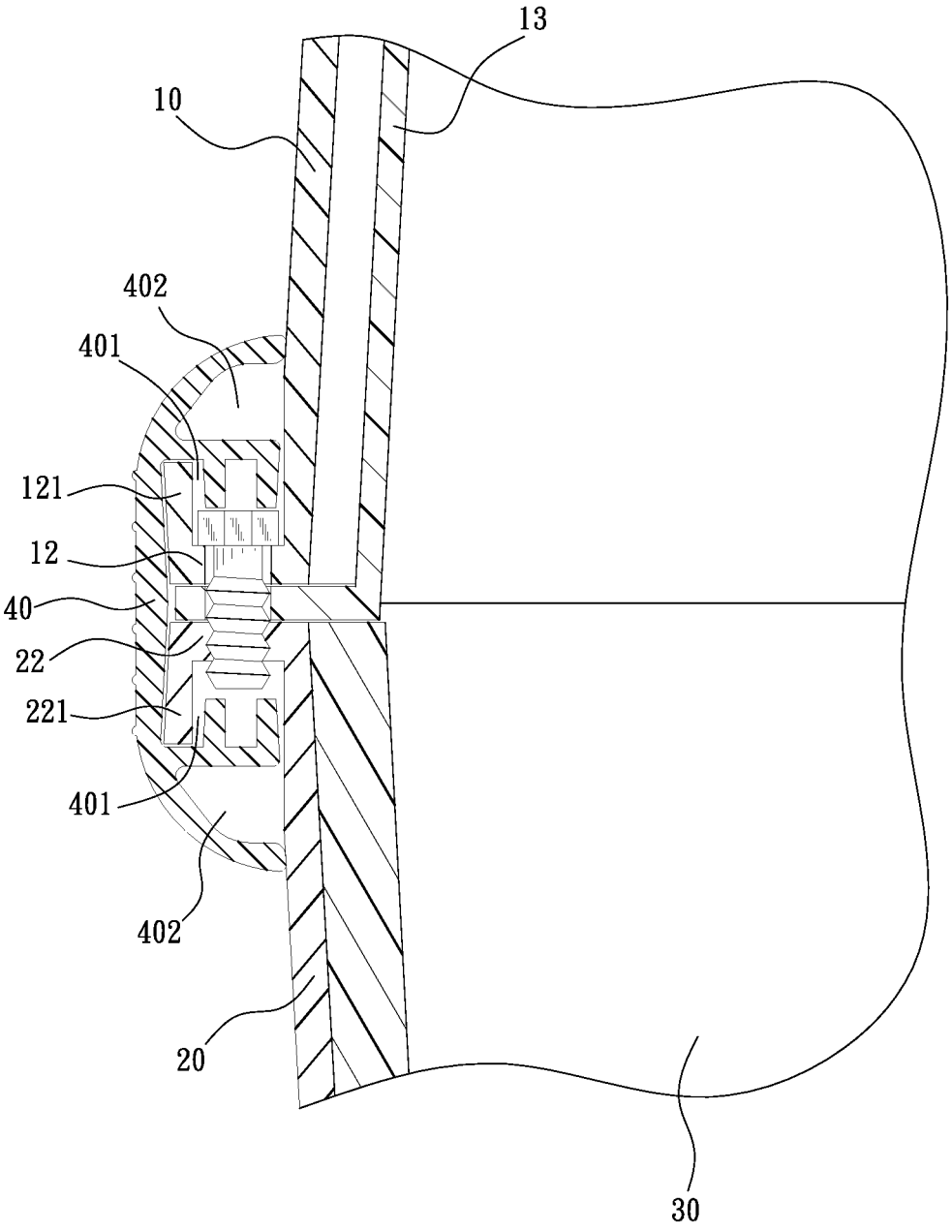
FIG. 5 is a sectional view taken along line 5-5 of FIG. 4.
Figure 6:
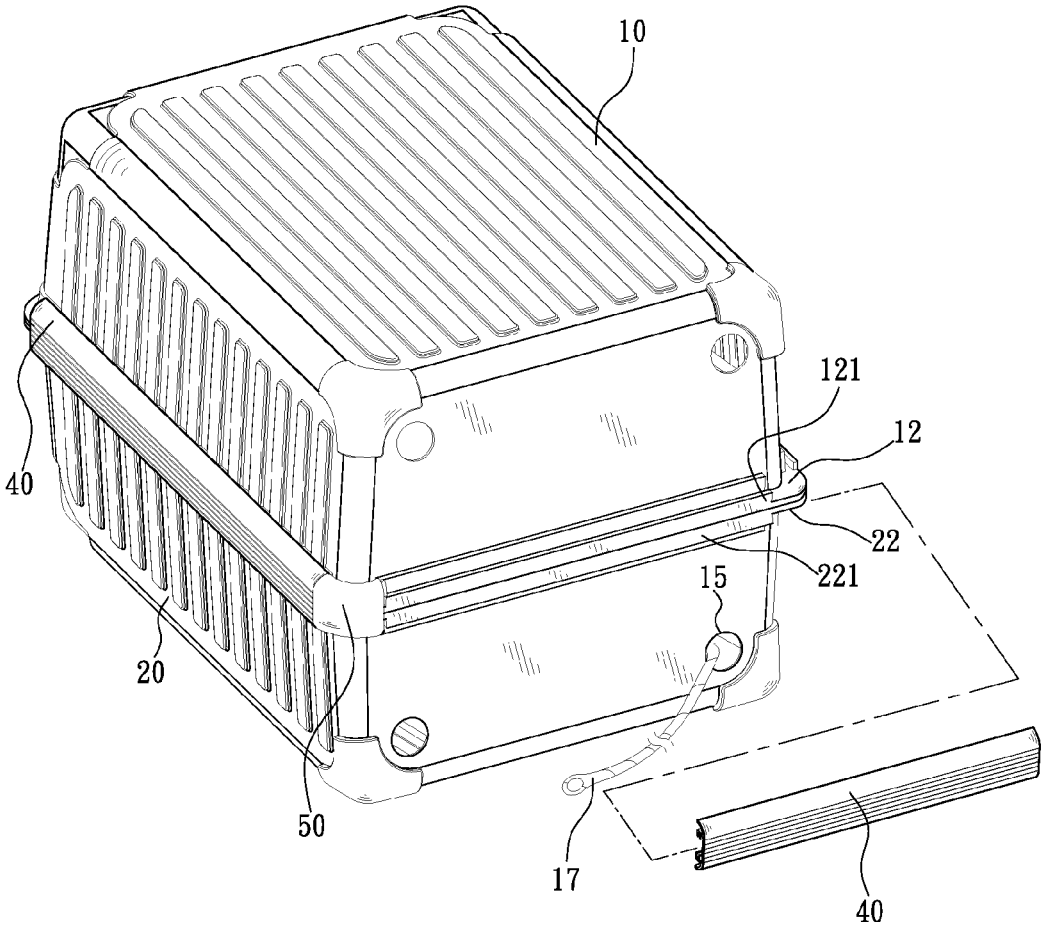
FIG. 6 is a schematic drawing illustrating an assembly process of the combination safe deposit box in accordance with the present invention (III).

After the side guard frames 40 are covered on the first side edge 12 and the second side edge 22, as shown in FIGS. 4-6, wrap the corners of the first side edge 12 and the second side edge 22. As the corners of the first side edge 12 and the corners of the second side edge 22 are overlapped together when the first box shell 10 and the second box shell 20 are abutted together, thus, the overlapped corners of the first side edge 12 and second side edge 22 can be inserted together into the coupling groove 51 of each of the corner guard frames 50. Thus, the corner guard frames 50 are tightly secured to the corners of the first side edge 12 and the corners of the second side edge 22 and respectively stopped against one respective end of the side guard frames 40, preventing a theft from detaching the side guard frames 40 with a pry.

When the first box shell 10 and the second box shell 20 are assembled together, the assembly can be used as a compact safety deposit box. Further, the partition board 14 divides the deposit space 30 in between the first box shell 10 and the second box shell 20 into two separated deposit chambers for storing different storage items. Further, a user can insert one respective metal chain 17 through one said through hole 15 on each of the first box shell 10 and the second box shell 20, and fasten one end of each metal chain 17 to the hollow column 16 of the first box shell 10 or second box shell 20 by a respective tie screw 18. At this time, the user can fasten the other end of each of the metal chains 17 to a selected place. Thus, the first box shell 10 and the second box shell 20 are tied to the selected place. Thus, the combination safe deposit box can be used at a fixed place, and will not be stolen easily. The other through holes 15 can be used for the insertion of a power cable.

Figure 7:
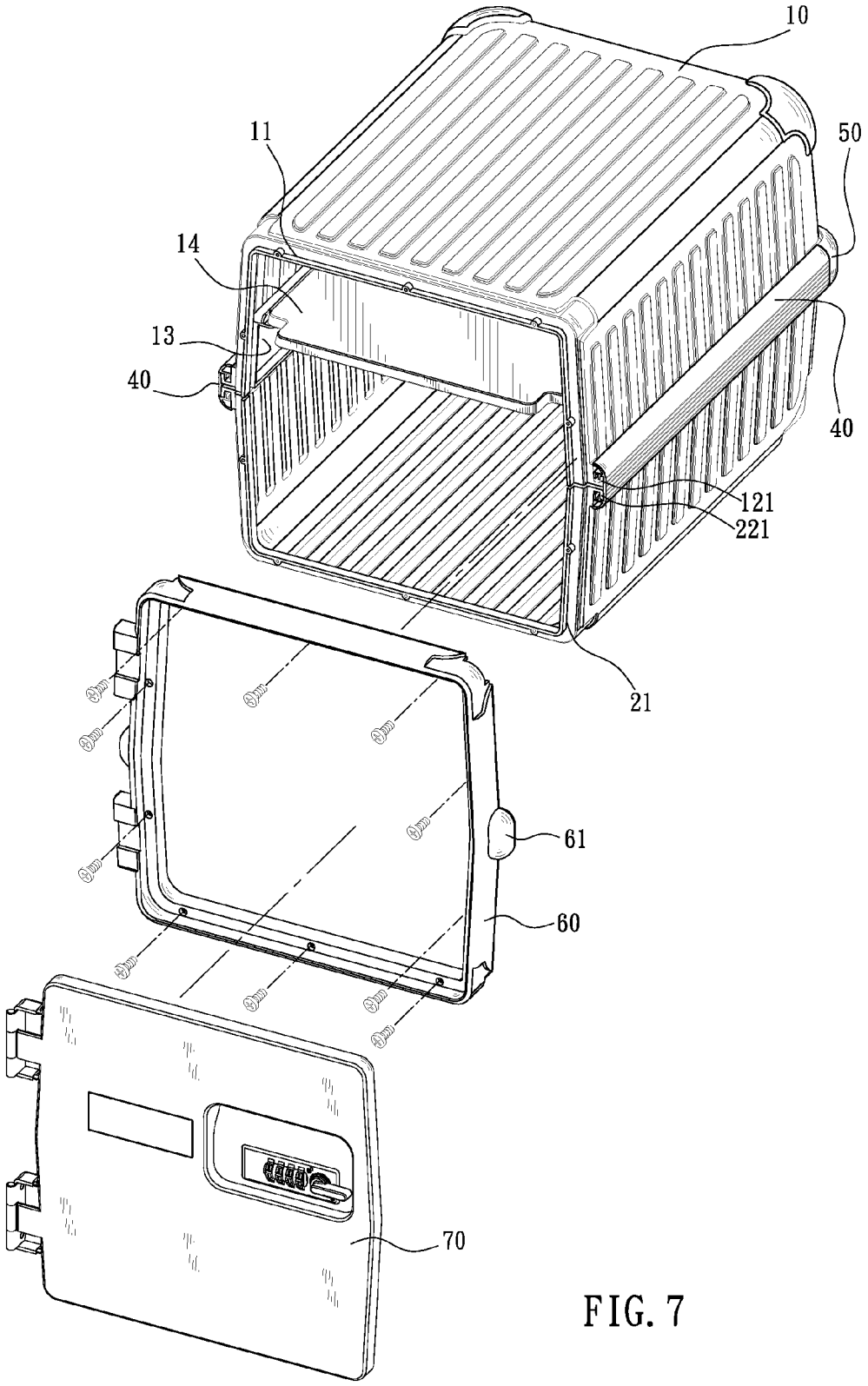
FIG. 7 is a schematic drawing illustrating an assembly process of the combination safe deposit box in accordance with the present invention (IV).

After installation of the side guard frames 40 and the corner guard frames 50, the rim frame 60 and the door panel 70 can then be installed, as depicted in FIG. 7. The aforesaid corner guard frames 50 are respectively stopped against one end of each of the two side guard frames 40 at the two opposite lateral sides of the combination safe deposit box. The two cap-shaped lugs 61 of the rim frame 60 are respectively capped on the other end of each of the two side guard frames 40 at the two opposite lateral sides of the combination safe deposit box, preventing a theft from detaching the respective side guard frame 40 with a pry from the front side of the combination safe deposit box.

Further, as shown in FIGS. 4-6, during installation of the corner guard frames 50, insert the pin 501 at each of the two distal ends of each corner guard frame 50 into one respective channel 402 of one respective side guard frame 40. At this time, the channel 402 of the side guard frame 40 at the back side of the combination safe deposit box receives one pin 501 of each of the two corner guard frames 50, and therefore the side guard frame 40 at the back side of the combination safe deposit box is stopped between the two corner guard frames 50.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination safe deposit box, comprising:

a first box shell being a substantially reverse U-shaped frame shell defining a front opening and a bottom opening, said first box shell having a first front edge surrounding said front opening and a first side edge surrounding said bottom opening;

a second box shell being a substantially U-shaped frame shell defining a front opening and a top opening, said second box shell having a second front edge surrounding said front opening and a second side edge connected to the first side edge of said first box shell;

a plurality of side guard frames respectively fastened to and covered on said first side edge and said second side edge;

a plurality of corner guard frames connected between each two said side guard frames;

a rim frame affixed to said first front edge and said second front edge to stop said side guard frames in place; and a door panel hinged to one side of said rim frame and adapted to close a deposit space defined in between said first box shell and said second box shell;

wherein said first box shell and said second box shell are fastened together; said side guard frames and said corner guard frames are respectively fastened to said first box shell and said second box shell and covered on said first side edge and said second side edge; said rim frame is affixed to said first front edge and said second front edge to stop said side guard frames and said corner guard frames in position.

2. The combination safe deposit box as claimed in claim 1, wherein said first box shell further comprises a first coupling flange extending along said first side edge; said second box shell further comprises a second coupling flange extending along said second side edge.

3. The combination safe deposit box as claimed in claim 2, wherein each said side guard frame comprises two parallel coupling grooves respectively coupled to the first coupling flange of said first box shell and the second coupling flange of said second box shell.

4. The combination safe deposit box as claimed in claim 1, further comprising two partition brackets bilaterally mounted in said first box shell and said second box shell.

5. The combination safe deposit box as claimed in claim 4, further comprising a partition board fastened to said partition brackets to divide the deposit space in between said first box shell and said second box shell into two separated deposit chambers.

6. The combination safe deposit box as claimed in claim 1, wherein each said corner guard frame comprises a coupling groove attached to one corner area of said first side edge and one respective corner area of said second side edge.

7. The combination safe deposit box as claimed in claim 1, wherein each said corner guard frame comprises at least one pin located on each of two distal ends thereof.

8. The combination safe deposit box as claimed in claim 7, wherein each said side guard frame comprises a channel adapted for receiving the at least one pin at each of the two distal ends of each of said corner guard frames.

9. The combination safe deposit box as claimed in claim 1, wherein said rim frame comprises two cap-shaped lugs respectively protruded from two opposite lateral sides thereof and respectively capped on one end of one respective said side guard frame to close the respective end of the respective side guard frame.

10. The combination safe deposit box as claimed in claim 1, wherein said first box shell and said second box shell each comprise at least one through hole, one hollow column, and one metal chain having one end thereof insertable through one said through hole for fixation to said hollow column and an opposite end thereof for fastening to an external place.

* * * * *